US009353611B2

(12) United States Patent
Graibus et al.

(10) Patent No.: US 9,353,611 B2
(45) Date of Patent: May 31, 2016

(54) METHOD AND APPARATUS FOR THE DOWNHOLE INJECTION OF SUPERHEATED STEAM

(71) Applicant: Trimeteor Oil and Gas Corporation, Las Vegas, NV (US)

(72) Inventors: Richard B Graibus, Las Vegas, NV (US); Jimmy L Turner, DeQueen, AR (US); Charles T McCullough, Las Vegas, NV (US); Dennis K Williams, Knoxville, TN (US)

(73) Assignee: Trimeteor Oil & Gas Corp., Las Vegas, NV (US)

( * ) Notice: Subject to any disclaimer, the term of this patent is extended or adjusted under 35 U.S.C. 154(b) by 466 days.

(21) Appl. No.: 14/064,784

(22) Filed: Oct. 28, 2013

(65) Prior Publication Data

US 2014/0124203 A1 May 8, 2014

Related U.S. Application Data

(60) Provisional application No. 61/721,618, filed on Nov. 2, 2012.

(51) Int. Cl.

| | |
|---|---|
| ***E21B 43/24*** | (2006.01) |
| ***E21B 36/00*** | (2006.01) |
| *E21B 43/12* | (2006.01) |

(52) U.S. Cl.
CPC ..... *E21B 43/24* (2013.01); *E21B 36/006* (2013.01); *E21B 43/126* (2013.01)

(58) Field of Classification Search
CPC ..... E21B 43/24; E21B 43/126; E21B 36/006
See application file for complete search history.

(56) References Cited

U.S. PATENT DOCUMENTS

| | | | |
|---|---|---|---|
| 213,556 | A | 3/1879 | Everding |
| 734,871 | A | 7/1903 | Hopwood |
| 1,342,741 | A | 6/1920 | Day |
| 1,457,479 | A | 6/1923 | Wolcott |
| 1,646,912 | A | 10/1927 | Hodshon |
| 1,753,522 | A | 4/1930 | Larsen |
| 1,949,182 | A | 2/1934 | Roberts |
| 2,173,556 | A | 9/1939 | Hixon |
| 2,584,606 | A | 2/1952 | Merriam |

(Continued)

OTHER PUBLICATIONS http://www.asme.org/kb/standards/bpvc-resources/boiler-and-pressure-vessel-code—2010-edition.

(Continued)

*Primary Examiner* — Shane Bomar
(74) *Attorney, Agent, or Firm* — Stephen D. Carver

(57) ABSTRACT

Superheated steam from a generator (10) proximate a well (14) is delivered through an output pipe (12) that communicates through a dual entry wellhead (17) with downhole steam piping (18) extending into the well (14). Steam is delivered at approximately 50 PSIG over the frictional and other losses encountered from the surface to the steam piping outlet (19). Oil is extracted through production tubing (20) passing through wellhead (17). Production tubing (20) and steam delivery piping (18) are secured in parallel relationship by clamps (46). The production tubing (20) communicates with a lift pump, and the steam piping (18) is terminated generally at a midpoint of the production tubing (20), several feet above the lift pump. A thermocouple (43) is placed approximately two feet below the end of the steam piping (18).

20 Claims, 10 Drawing Sheets

(56) References Cited

U.S. PATENT DOCUMENTS

| | | | | | |
|---|---|---|---|---|---|
| 2,606,272 | A | | 8/1952 | Platt | |
| 2,647,585 | A | | 8/1953 | Roberts | |
| 2,734,578 | A | | 2/1956 | Walter | |
| 2,825,408 | A | | 3/1958 | Watson | |
| 2,929,451 | A | * | 3/1960 | Hurlstone | E21B 36/00 166/303 |
| 3,243,575 | A | | 3/1966 | Vignere | |
| 3,373,805 | A | * | 3/1968 | Boberg | E21B 36/00 166/302 |
| 3,419,666 | A | | 12/1968 | Groom | |
| 3,465,826 | A | * | 9/1969 | Terwilliger | E21B 43/24 166/303 |
| 4,398,603 | A | | 8/1983 | Rodwell | |
| 4,408,116 | A | | 10/1983 | Turner | |
| 4,452,491 | A | * | 6/1984 | Seglin | E21B 43/28 166/267 |
| 4,582,480 | A | | 4/1986 | Lynch | |
| 4,668,854 | A | | 5/1987 | Swan | |
| 4,744,160 | A | | 5/1988 | Elliott | |
| 5,142,608 | A | | 8/1992 | Meshekow | |
| 5,275,639 | A | * | 1/1994 | Sullivan | C05B 11/06 423/317 |
| 5,949,958 | A | | 9/1999 | Naperkowski | |
| 6,015,015 | A | * | 1/2000 | Luft | E21B 17/1007 166/241.6 |
| 6,094,523 | A | | 7/2000 | Zelina | |
| 6,095,098 | A | | 8/2000 | Beal | |
| 6,129,148 | A | | 10/2000 | Meeks | |
| 6,135,062 | A | | 10/2000 | Palmers | |
| 6,488,219 | B1 | | 12/2002 | Herr | |
| 6,491,096 | B1 | * | 12/2002 | Masek | E21B 43/24 166/275 |
| 7,031,601 | B2 | | 4/2006 | Zheng | |
| 7,092,519 | B1 | | 8/2006 | Lindholm | |
| 7,832,482 | B2 | | 11/2010 | Cavender | |
| 2004/0097774 | A1 | * | 5/2004 | Hall | B01J 8/02 585/658 |
| 2005/0117625 | A1 | * | 6/2005 | Ogle | G01N 25/50 374/141 |
| 2010/0276139 | A1 | * | 11/2010 | Tillman | E21B 36/02 166/251.1 |
| 2011/0116775 | A1 | * | 5/2011 | Turner | F22B 1/285 392/399 |
| 2012/0103604 | A1 | * | 5/2012 | Mohamed | E21B 43/24 166/272.1 |
| 2014/0216733 | A1 | * | 8/2014 | Mathiesen | E21B 34/08 166/252.5 |

OTHER PUBLICATIONS http://www.asme.org/kb/standards/bpvc-resources/boiler-and-pressure-vessel-code---2010-edition.

* cited by examiner

METHOD AND APPARATUS FOR THE DOWNHOLE INJECTION OF SUPERHEATED STEAM

CROSS REFERENCE TO RELATED APPLICATION

This utility patent filing is based upon and claims the effective filing date of a prior U.S. Provisional patent application entitled "Method and Apparatus for the Downhole Injection of Superheated Steam", Ser. No. 61/721,618, filed Nov. 2, 2012, with coinventors Richard B. Graibus, Jimmy L. Turner, Charles T. McCullough, and Dennis K. Williams.

BACKGROUND OF THE INVENTION

1. Field of the Invention

The present invention relates generally to the downhole delivery of superheated steam for recovering crude oil of low specific gravity, for enhancing reservoir drive, and for deparrafinization. More particularly, the invention relates to enhanced oil recovery methods and apparatus for subterraneously steam with a heat capacity consistent with 900 degrees F. of superheat, i.e., steam at a minimum temperature of 900 degrees F. above the saturation temperature of a water/steam mixture, at a pressure sufficient to overcome the frictional pressure losses associated with the downhole piping surface roughness, the steam mass flow rate, and the downhole inside geometric parameters that exist from the top side surface to the steam piping outlet at the bottom of the well bore, concurrently with normal oil extraction processes that function through separate production tubing.

2. Description of the Related Art

It has long been recognized in the art that, when the natural drive energy of an oil reservoir or well decreases over time, it becomes increasingly difficult to raise oil to the surface. As pressure decreases over time, secondary and tertiary methods are used to bring oil to the well bore where it may be retrieved. Artificial lift at the well bore will be required to achieve sufficient production. Various artificial lift processes are commonly used to increase reservoir pressure and to force oil to the surface at some time during the production life of a well.

The two most common methods of inducing of artificial lift in wells are broadly referred to as "pumping" and "gas injection". Beam pumping engages equipment above and below ground to increase pressure and push oil to the surface. Beam pumps, consisting of a sucker rod string and a sucker rod pump, are exemplified by the common, black-colored jack pumps employed by onshore oil wells that create suction to lift the oil.

Above the surface, the beam pumping system rocks back and forth, reciprocating a string of sucker rods, which plunge down into the well bore. The sucker rods are connected to the sucker rod pump, which is installed as a part of the tubing string near the bottom of the well. The beam pumping system rocks back and forth to operate the rod string, sucker rod and sucker rod pump. The sucker rod pump lifts the oil from the reservoir through the well to the surface. Artificial lift pumping can also be accomplished with a downhole hydraulic pump, rather than sucker rods, or with electric submersible pump systems deployed at the bottom of the tubing string. An electric cable runs the length of the depth of the well.

Artificial lift systems can employ gas injection to reestablish pressure, making a well produce. Injected gases or vapors reduce the pressure on the bottom of the well by decreasing the viscosity of the fluids in the well. This, in turn, encourages the fluids to flow more easily to the surface. Typically, the gas that is injected is recycled with fluids produced from the well.

Gas lift is the optimal choice for offshore applications. Occurring downhole, the compressed gas is injected down the casing tubing annulus, entering the well at numerous entry points called gas-lift valves. As the gas enters the tubing at these different stages, it forms bubbles, lightens the fluids/and lowers the pressure.

It is well known in the art to inject high temperature steam within wells to decrease the viscosity of heavy crude oils, facilitating subsequent pumping and recovery. The temperature of the injected steam must be at or above the saturation temperature at a given injection pressure. Injected steam warms the well bore, heating the piping, the casings, and the surrounding environment. Injected steam must not only be of sufficient temperature and pressure to properly liquefy targeted crude oil within the well, but a sufficient volume of such steam is required during the injection process for success. In general, in the prior art, large volume demands mitigate against the successful operational maintenance of the requisite applied steam temperature.

Steam generators for supplying superheated steam are known in the art. For example, U.S. Pat. No. 4,408,116 issued to Turner on Oct. 4, 1983 discloses a superheated steam generator with dual heating stages. A more recent steam generator design is illustrated in our prior patent U.S. Pat. No. 8,359.919 issued Jan. 22, 2013 and entitled "Super Heated Steam Generator With Slack Accommodating Heating Tanks," that is owned by the same assignee as in this case.

There are currently several different forms of steam injection technology for oil recovery. The two primary prior art methods are "Cyclic Steam Stimulation" and "Steam Flooding." The "Cyclic Steam Stimulation" method, also known as the "Huff and Puff" method, consists of injection, soaking, and production stages. Steam is first injected to heat the oil in the reservoir to raise the temperature and lower the oil viscosity, thereby enhancing fluid flow. Injected steam may be left in the well for periods of time for soaking and diffusion of the steam into the well environment. Subsequently, oil is extracted from the treated well, at first by natural flow (since the steam injection will have increased the reservoir pressure) and then by artificial lift. Production decreases as the oil/steam mixture cools, necessitating repetition of the steam injection steps. The "huff and puff" method thus injects steam in periodic cycles, applying periodic "puffs" of steam between periodic soaking periods, during which the steam generator apparatus recharges and accumulates another volume of steam for subsequent injection. The "huff and puff" process is most effective in the first few steam cycles. However, it is typically only able to recover approximately 20% of the Original Oil in Place (OOIP), compared to steam flooding, which has been reported to recover over 50% of OOIP.

Steam flooding involves multiple wells. Some wells are used as steam injection wells, and others are used for oil production. Two mechanisms are at work to improve the amount of oil recovered. The first is to heat the oil to higher temperatures and to thereby decrease its viscosity so that it flows more easily through the formation toward the producing wells. A second mechanism is the physical displacement of oil in a manner similar to water flooding, in which oil is meant to be pushed to the production wells. While more steam is needed for this method than for cyclic steam simulation methods, it is typically more effective at recovering a larger portion of the oil.

A form of steam flooding termed "steam assisted gravity drainage", abbreviated "SAGD," utilizes multiple, spaced apart, horizontal wells. Steam is injected into the upper SAGD well in an effort to reduce the viscosity of the oil deposits to the point where gravity will pull the oil into the producing well.

However, it has become evident to us that, for maximum crude oil recovery efficiency, superheated steam can be injected concurrently with the extraction operation in a single well. In this manner, time delays are avoided, and additional energy is available through the large number of degrees of superheat (defined as the difference between the actual steam temperature and the saturation temperature at the delivery pressure). Thus the requirement of supplemental wells is obviated.

BRIEF SUMMARY OF THE INVENTION

The present invention comprises methods and apparatus for delivering superheated, low pressure steam downhole within a well bore concurrently with the extraction of crude oil from the production piping. A high volume of superheated steam is injected continuously, concurrently with oil production. Superheated steam is preferably injected at temperatures in excess of 900 degrees F. above the saturation temperature of steam at the coincident pressure that is necessary to overcome the downhole frictional pressure losses plus an additional 50 PSIG margin.

Preferably, the process allows the well pump to continue pumping while the superheated steam is delivered into the well, heating the available crude deposit and lessening the viscosity. A separate steam pipe extends through a dual entry wellhead down the well bore. Preferably the steam piping is strapped to the well bore production tubing with straps configured generally in the shape of a "figure 8.", and thus the steam delivery piping is parallel with the production tubing. The steam pipe fits into the annulus between the well bore casing and the production tubing. This installation method allows the oil well pump to continue to operate while superheated steam is being delivered to the bottom of the well bore.

Thus a basic object of this invention is to provide an enhanced, artificial lift system for wells.

Another object is to provide an improved, downhole gas injection process that delivers superheated steam at high output temperatures.

A related object is to provide a gas injection system for wells utilizing superheated steam.

Similarly, it is an object of this invention to provide a superheated steam gas injection system that is compatible with artificial lift pumping systems.

It is also a basic object to provide a steam delivery means for practicing enhanced, secondary oil recovery or tertiary oil recovery.

A related object is to direct superheated steam within a well during secondary or tertiary oil recovery, such that steam fills up the voids left by extracted oil and steam pressure contributes to lift to ease extraction.

A related object is to provide a superheated steam, downhole injection apparatus compatible with existing well piping for injecting superheated steam.

A basic object of our invention is to provide a reliable, downhole delivery system for utilizing superheated steam to recover crude oil.

Another object of this invention is to provide methods and apparatus for injecting superheated steam downhole at high volumes which is capable of high output temperatures of approximately 900-1500 degrees F.

More particularly, an object of the invention is to provide a downhole system for subterraneously injecting steam with a heat capacity consistent with 900 degrees F. of superheat, i.e., steam at a minimum temperature of 900 degrees F. above the saturation temperature of a water/steam mixture, at an internal pressure sufficient to overcome the frictional pressure losses associated with the downhole piping surface roughness, the steam mass flow rate, and the downhole inside geometric parameters that exist from the top side surface to the steam piping outlet at the bottom of the well bore, concurrently with normal oil extraction processes that function through separate production tubing.

A related object is to provide a downhole injection apparatus for superheated steam of the character described that concurrently delivers steam during the oil extraction process through the normal production tubing.

Another object is to deliver superheated steam down a well bore concurrently with the extraction of oil through the well piping.

Yet another object of our invention is to reduce the time delays associated with prior art "huff and puff" systems.

It is also an object to obviate the need for auxiliary wells that are typically required in prior art steam flooding techniques.

Fundamentally, it is an important object to continuously heat crude oil deposits deep within wells during extraction, to lower the viscosity of the oil, and to thus speed up the recovery process.

These and other objects and advantages of the present invention, along with features of novelty appurtenant thereto, will appear or become apparent in the course of the following descriptive sections.

BRIEF DESCRIPTION OF THE SEVERAL VIEWS OF THE DRAWINGS

In the following drawings, which form a part of the specification and which are to be construed in conjunction therewith, and in which like reference numerals have been employed throughout to indicate like parts in the various views.

DETAILED DESCRIPTION OF THE INVENTION

Figure 1:
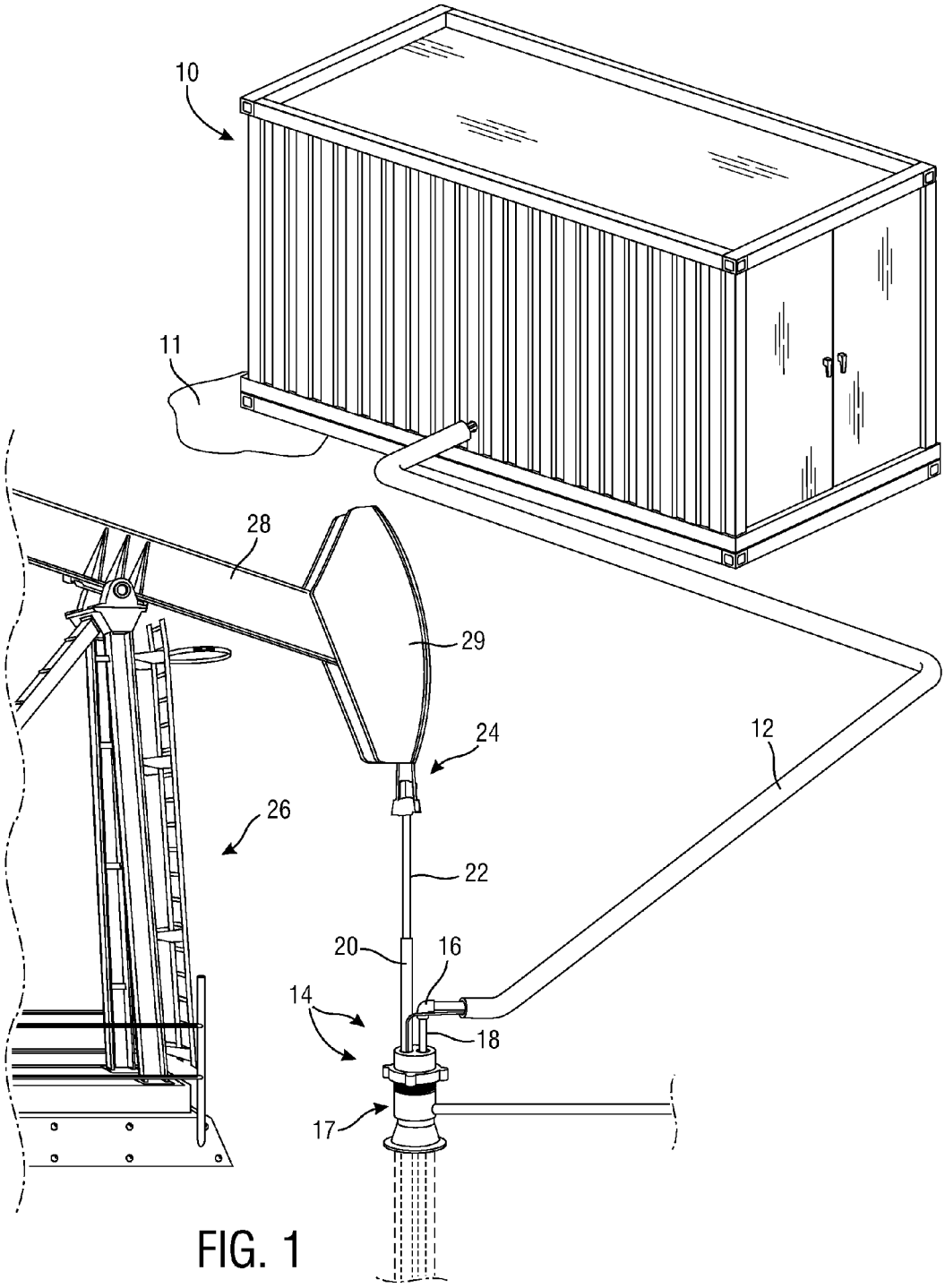
FIG. 1 is a fragmentary. pictorial and diagrammatic view showing an overview of our superheated steam distribution apparatus employed with the preferred method.
Figure 2:
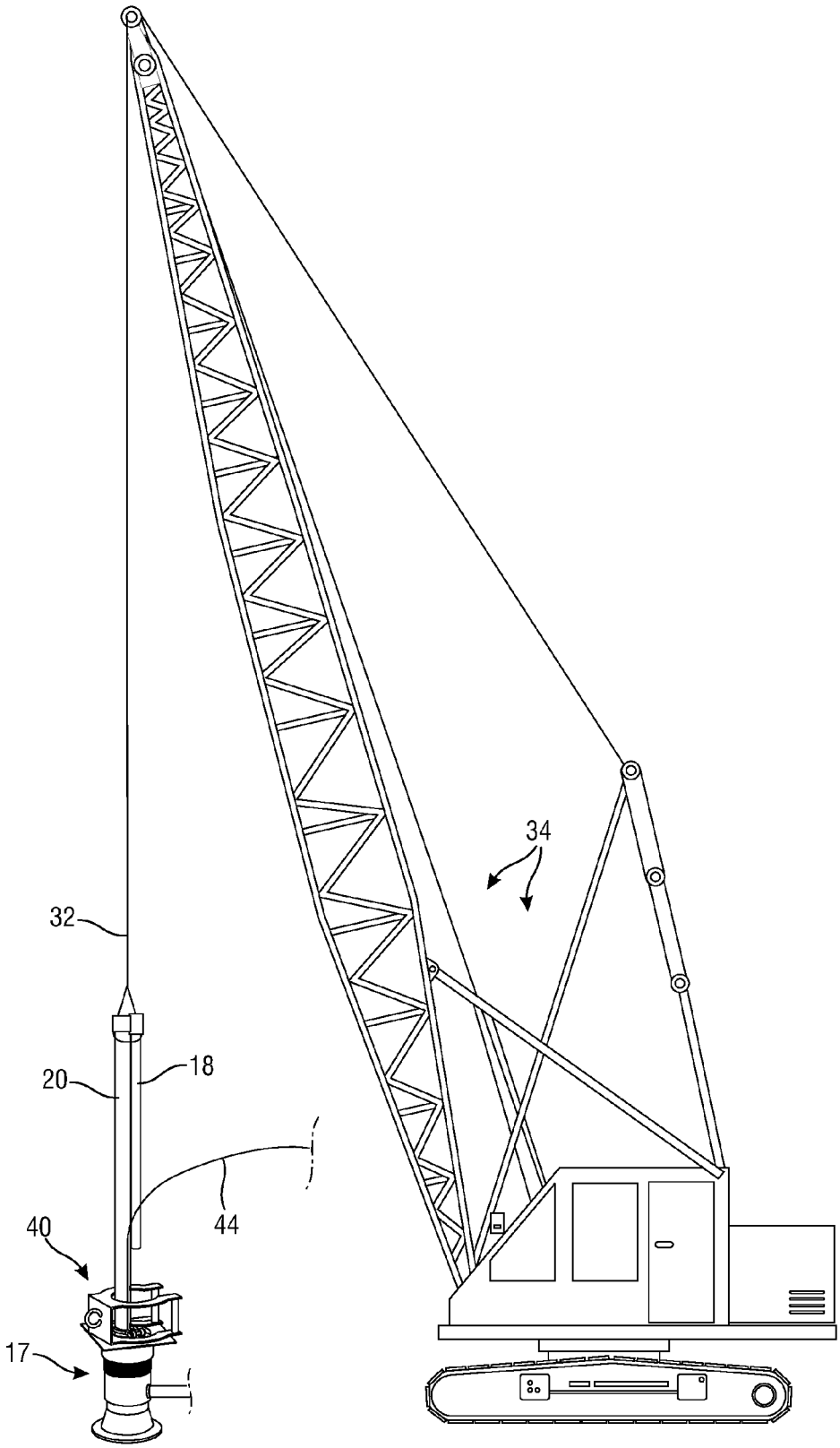
FIG. 2 is a fragmentary pictorial and diagrammatic view showing installation of a steam delivery pipe, the downhole thermocouple, and production tubing at a dual entry wellhead proximate a producing well.

As is well recognized by those skilled in the art, steam generated through a variety of techniques can be injected into wells through various piping arrangements for secondary and tertiary oil recovery. With initial reference now directed to FIGS. 1 and 2 of the appended drawings, a high volume of superheated steam, preferably at a temperature between approximately 1000 degrees F. and 1600 degrees F., is produced and supplied by a steam generator, which has been generally designated by the reference numeral 10.

A suitable superheated steam generator is illustrated in our prior U.S. Pat. No. 8,358,919, issued Jan. 22, 2013, entitled "Super Heated Steam Generator With Slack Accommodating Heating Tanks," the entire disclosure of which is hereby incorporated by reference as if fully set forth herein.

However, in the best mode known to us at this time, results obtained with the instant downhole injection teachings are maximized by supplying steam through the techniques and apparatus described in our presently copending applications as follows: U.S. Patent Application No. 20130136435, published May 30, 2013 and entitled "Methods for Super Heated Steam Generation"; U.S. Patent Application No. 20130136434 published May 30, 2013 and entitled "Automated Super Heated Steam Generators"; and, U.S. Patent Application No. 20130136433 published May 30, 2013 and entitled "Superheated Steam Generators." For purposes of enablement and disclosure, the aforesaid three published applications are hereby incorporated by reference as if fully set forth herein.

The superheated steam generator 10 may be disposed on a supporting surface 11, such as the base of a flatbed truck trailer, proximate the well 14. Steam is delivered from generator 10 through an elongated, insulated, steam output pipe 12 (FIG. 1) that communicates through an elbow 16 and a dual entry wellhead 17 with the downhole steam piping 18. Preferably the output pipe 12 should have as few bends as possible, and long radius bends are preferred when bends are necessary. One suitable dual entry wellhead comprises a Model 92 dual string tubing head available from Larkin Products in Waxahachie Texas.

Figure 5:
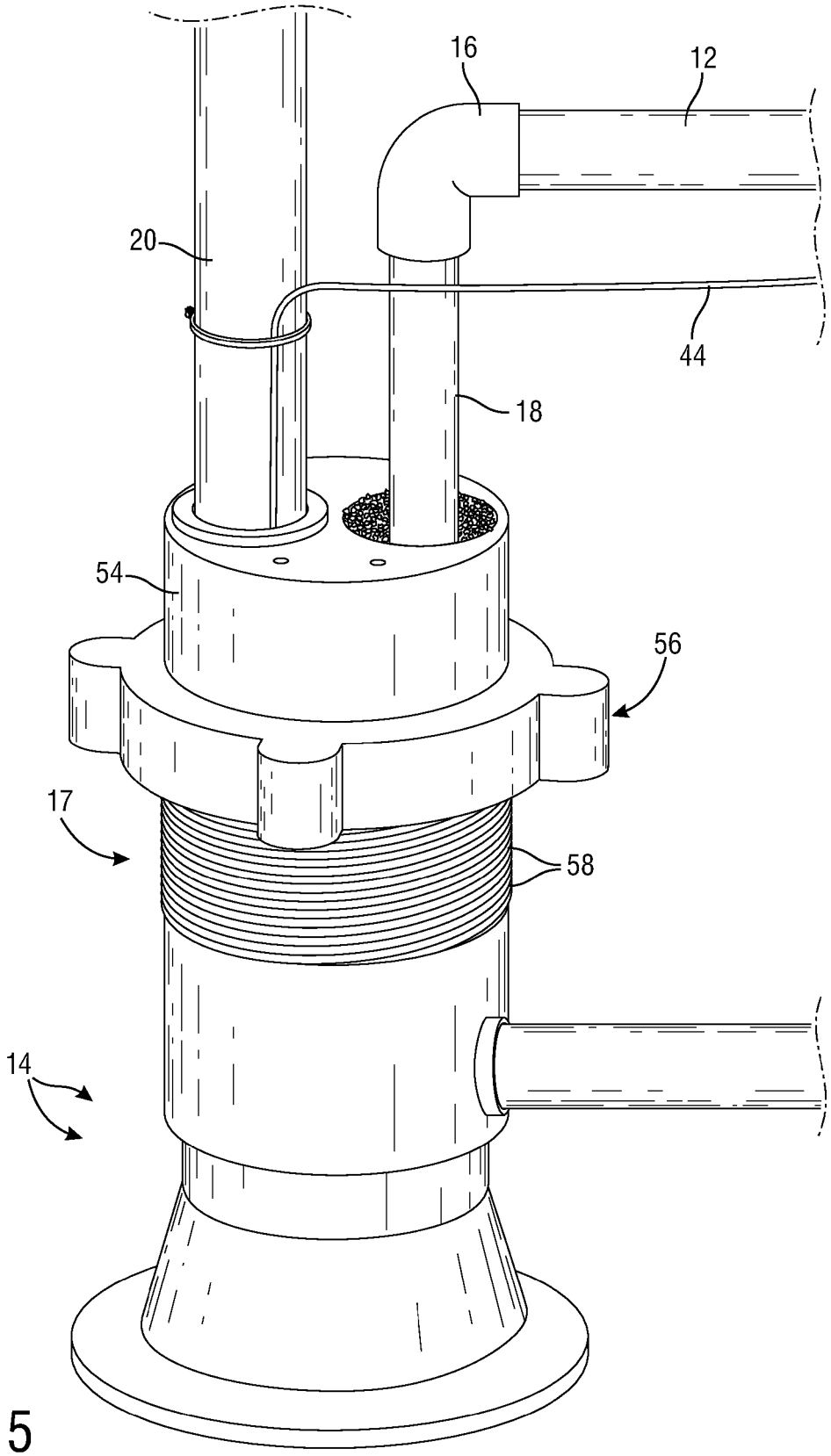
FIG. 5 is a view similar to FIG. 4, with the jaws omitted, showing the appearance of the steam pipe, the production piping and thermocouple wiring at the top of the wellhead after the pipes have been submerged down within the well.

Also entering the dual entry wellhead 17 (FIG. 5) is a production tubing 20 that is coaxially engaged by a polished rod 22 (comprising part of a conventional sucker rod string) manipulated by bridle 24. A conventional pump jack 26 is disposed proximate the well. As recognized by those skilled in the art, pump jack 26 rocks an overhead walking beam 28 that rocks the horsehead 29 upwardly and downwardly to create suction for extracting oil through the production tubing 20 by reciprocating a sucker rod string, as known in the art. With additional reference jointly directed to FIG. 2, installation over an open well bore proceeds with a conventional crane 34 that lifts the apparatus into position with suitable cabling 32. Lengths of production tubing 20 and steam delivery piping 18 are lowered through the dual entry wellhead 17 with the aid of a hydraulic drill pipe tong 40. Preferably a downhole thermocouple assembly including thermocouple 43 (FIG. 8) is lowered in place as well, which, as recognized by those skilled in the art, is sized and configured to match weight and load requirements. Suitable hydraulic drill pipe tongs include the ZQ series of tongs available from Rugao Yaou Co. LTD., Room 907 13#, Jinjiuhuafu, Ninghai RD, Rugao, Jiangsu, China.

Figure 3:
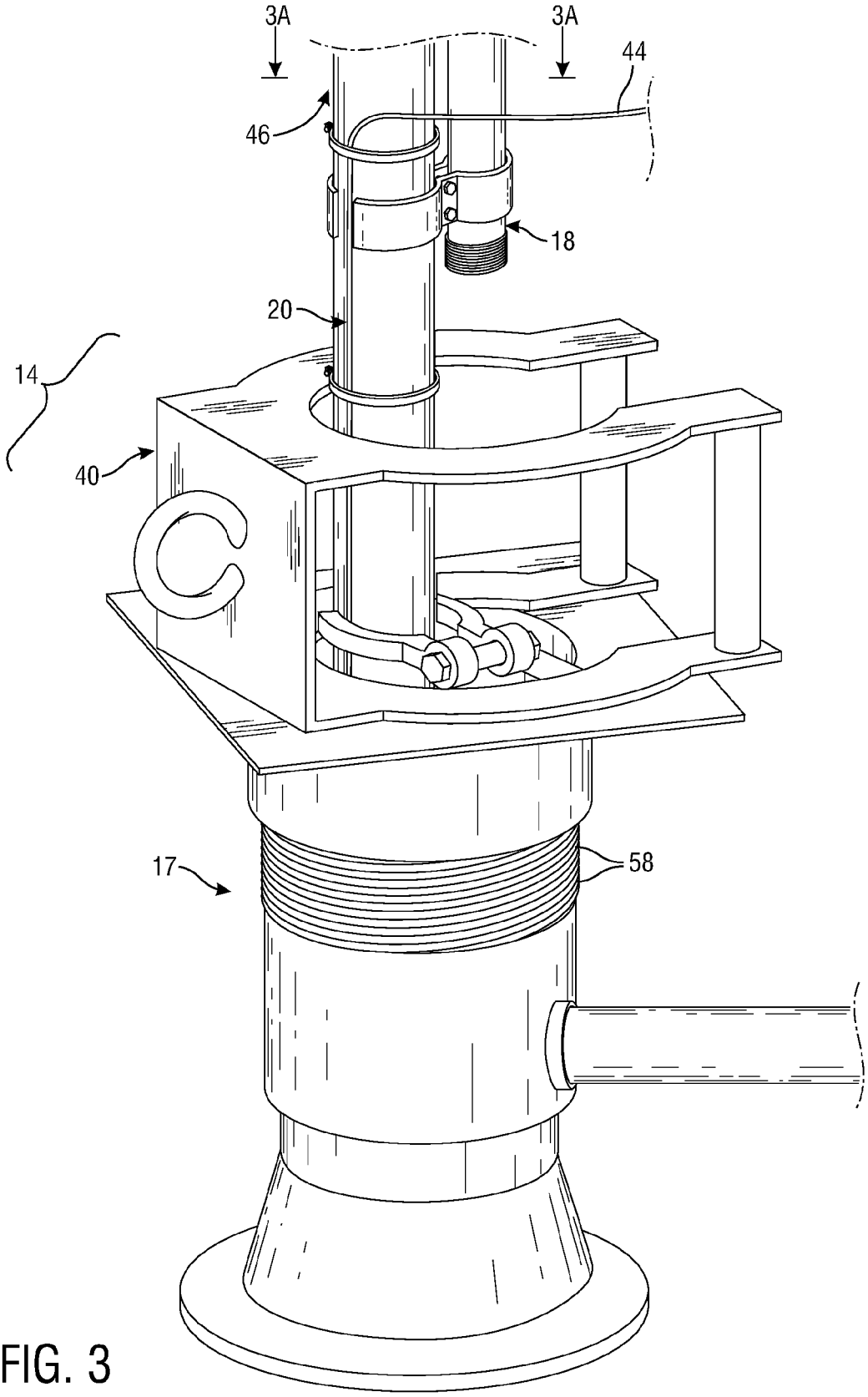
FIG. 3 is an enlarged, partially fragmentary, isometric view showing installation and positioning jaws applied to production piping and steam piping proximate the dual entry wellhead prior to immersion within the well, with portions thereof omitted for clarity.
Figure 3A:
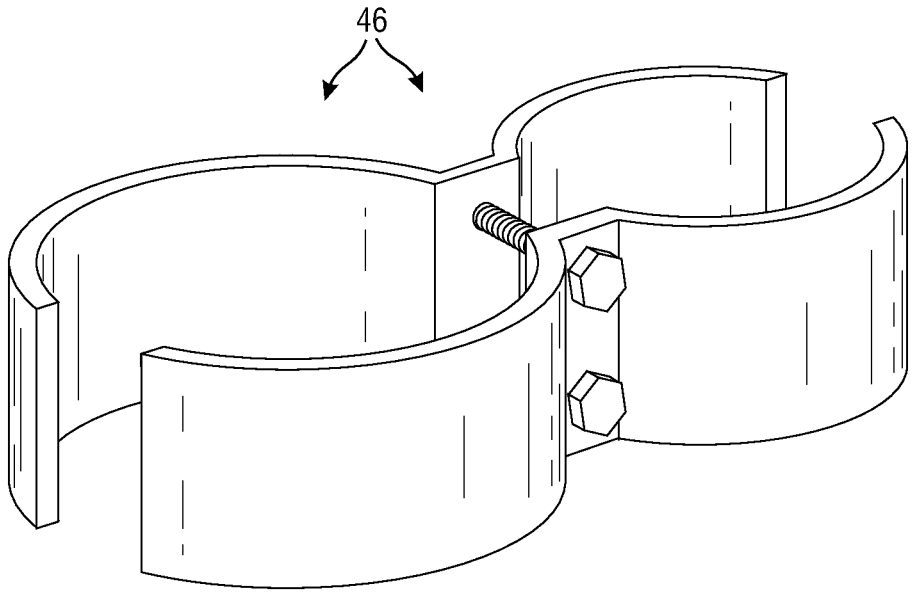
FIG. 3A is an enlarged, fragmentary sectional view taken generally along line 3A-3A in FIG. 3 in the direction of the arrows, showing the preferred strapping.

With joint reference now directed to FIGS. 3 and 3A, the production tubing 20 and the steam delivery piping 18 are preferably secured in a parallel, spaced apart relationship by a plurality of spaced-apart "Stauff" type clamps 46. Noting FIG. 3A, suitable clamps are preferably type SSS steel clamps available from Stauff Im Ehrenfeld 458791, Werdohl, Germany. Alternatively the hot steam delivery piping 18 is strapped to the production tubing 20 to heat it when heavy paraffin conditions exist. Because of the temperature range of up to 1600° F., it is critical that the down hole steam delivery piping 18 must be made of a material that withstands the heat, such as stainless steel. In the best mode, type 617 inconel stainless steel is used.

With wells that have large amounts of paraffin, the steam delivery piping 18 is uninsulated to warm the production piping. In a well with low paraffin, the steam delivery piping is preferably insulated for efficiency.

As the viscosity of the extracted mixture is lowered by heating, sand tends to be discarded because of differential densities. The attachment of the steam piping 18 to the production tubing 20 is accomplished through the utilization of mechanical coupling and piping guides 46 that are consistent with the differential temperatures of the respective two pipes and the materials of construction of each respective pipe. The relative axial and circumferential displacements associated with the differential temperatures and materials of construction of the two pipes are controlled within acceptable National consensus codes and standards through the properly selected attachment coupling and pipe guides.

Thermocouples (or other heat measuring devices) are attached to the production tubing 20 at each joint of the production tubing. One acceptable thermocouple is the East Coast Sensors type K thermocouple probe, comprising a single element, ungrounded junction, that is magnesium oxide insulated, extending the length of the down hole steam pipe and made of 316 stainless steel. The thermocouple 43 (FIG. 8) can be monitored through wires 44 with an Extech-brand digital thermometer. This thermocouple 43 should be offset from the production tubing one to two inches to measure ambient temperatures within the environment.

Figure 4:
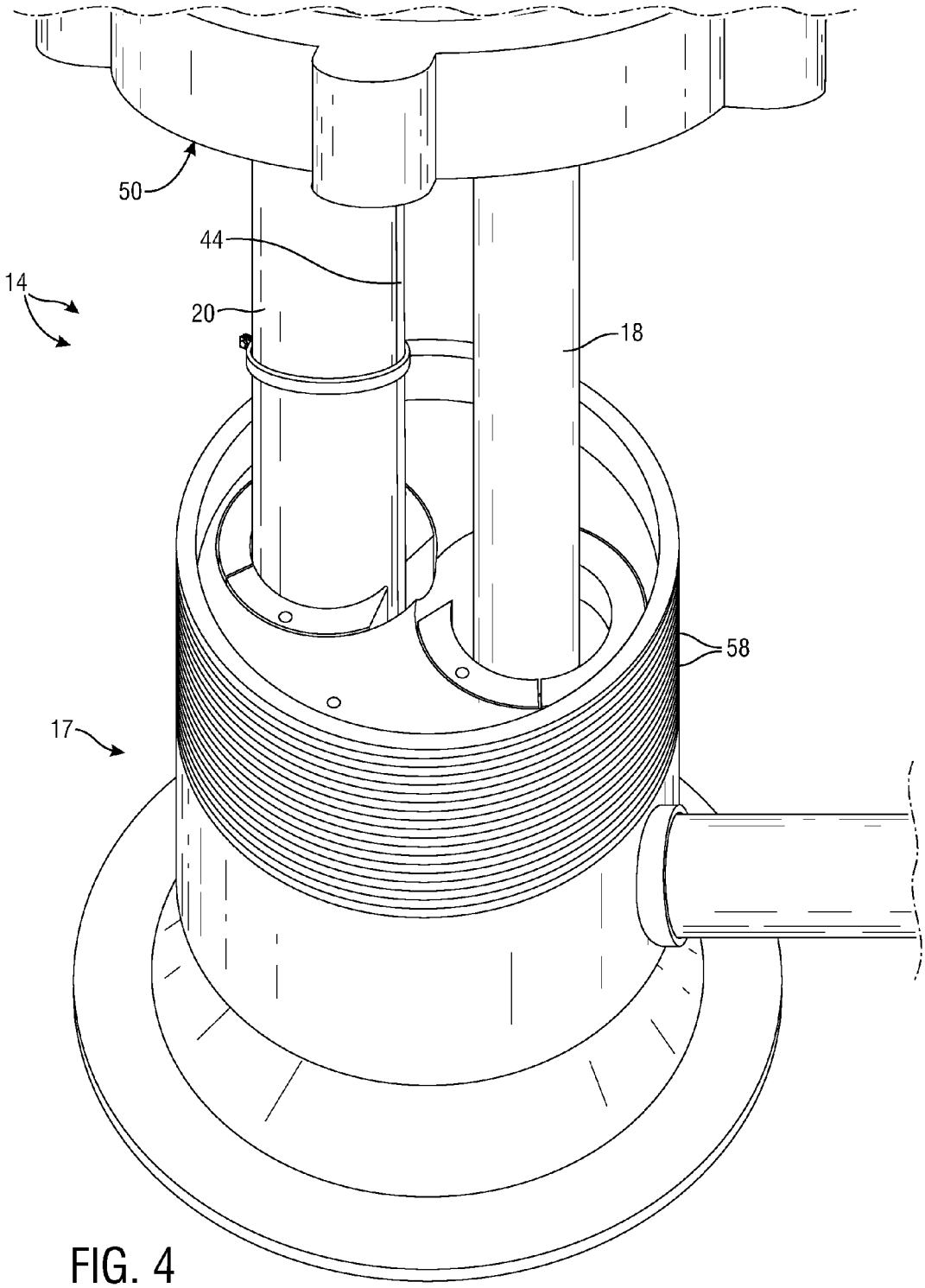
FIG. 4 is an enlarged, fragmentary isometric view similar to FIG. 3, showing upper portions of the dual entry wellhead, with portions omitted for clarity.

Noting FIGS. 3 and 4, the production tubing 20, the steam piping 18, and the downhole thermocouple line 44 are laterally stabilized by the dual entry wellhead 17. After installation of the latter, a protective casing 54 is secured in place by a conventional casing top nut 56 that engages threads 58 on the dual entry wellhead 17.

Figure 6:
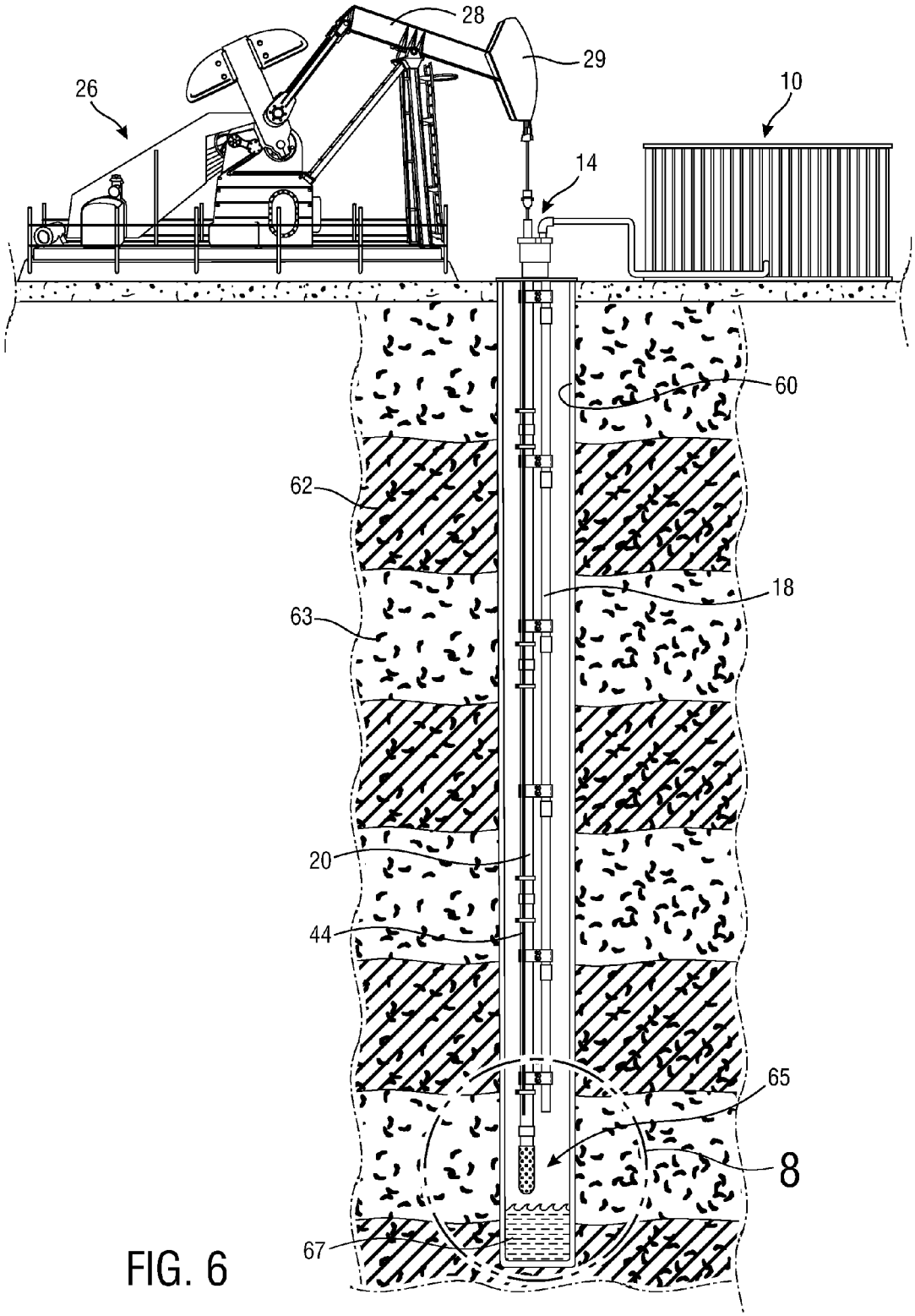
FIG. 6 is a combined diagrammatic and sectional view showing the above-ground portions of the invention and subterranean portions of the invention including a penetrating mulch-section, downhole pipe, with portions thereof shown in section for clarity or omitted for brevity.
Figure 6A:
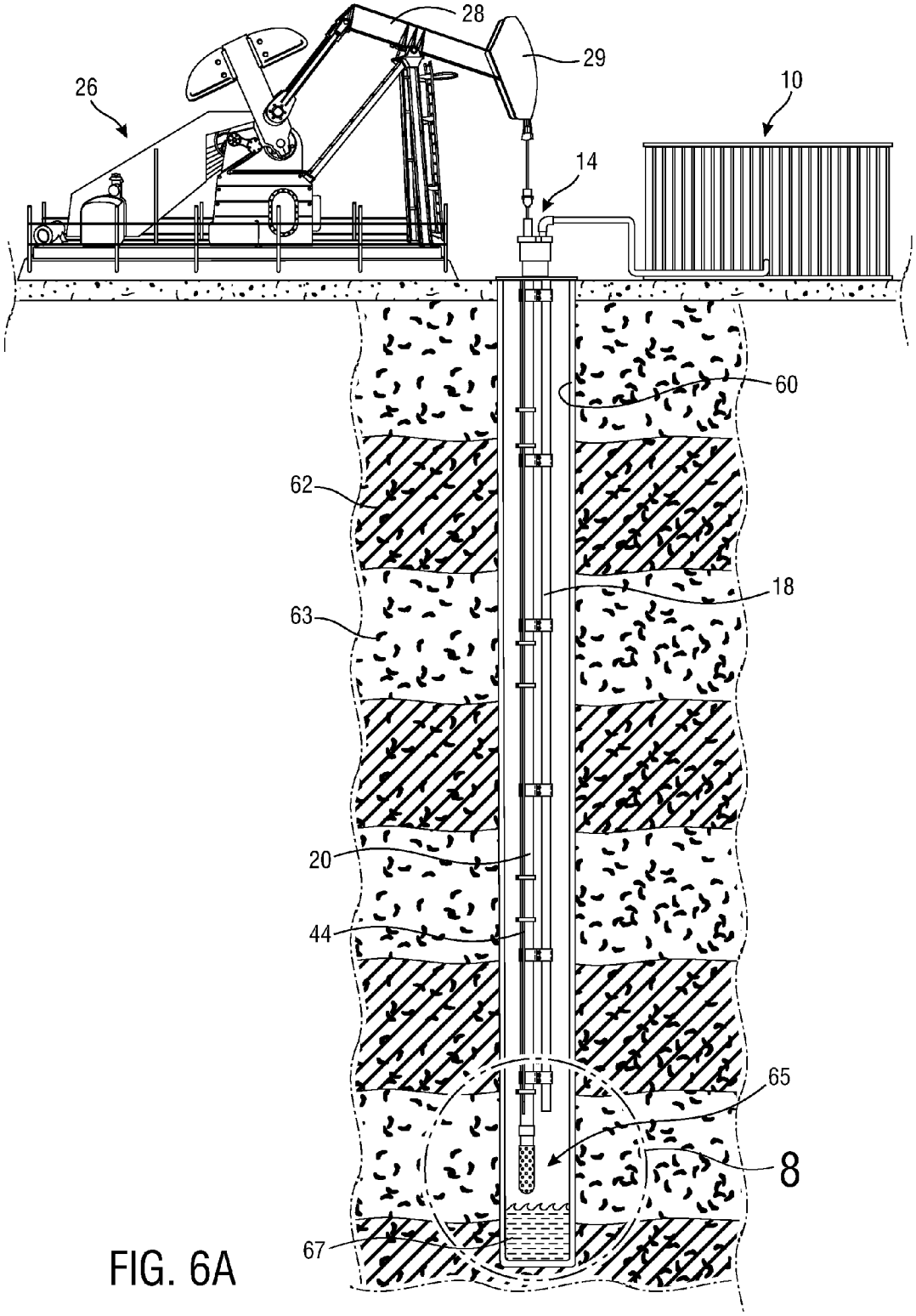
FIG. 6A similar is view similar to FIG. 6 but showing a continuous single piece downhole pipe.
Figure 7:
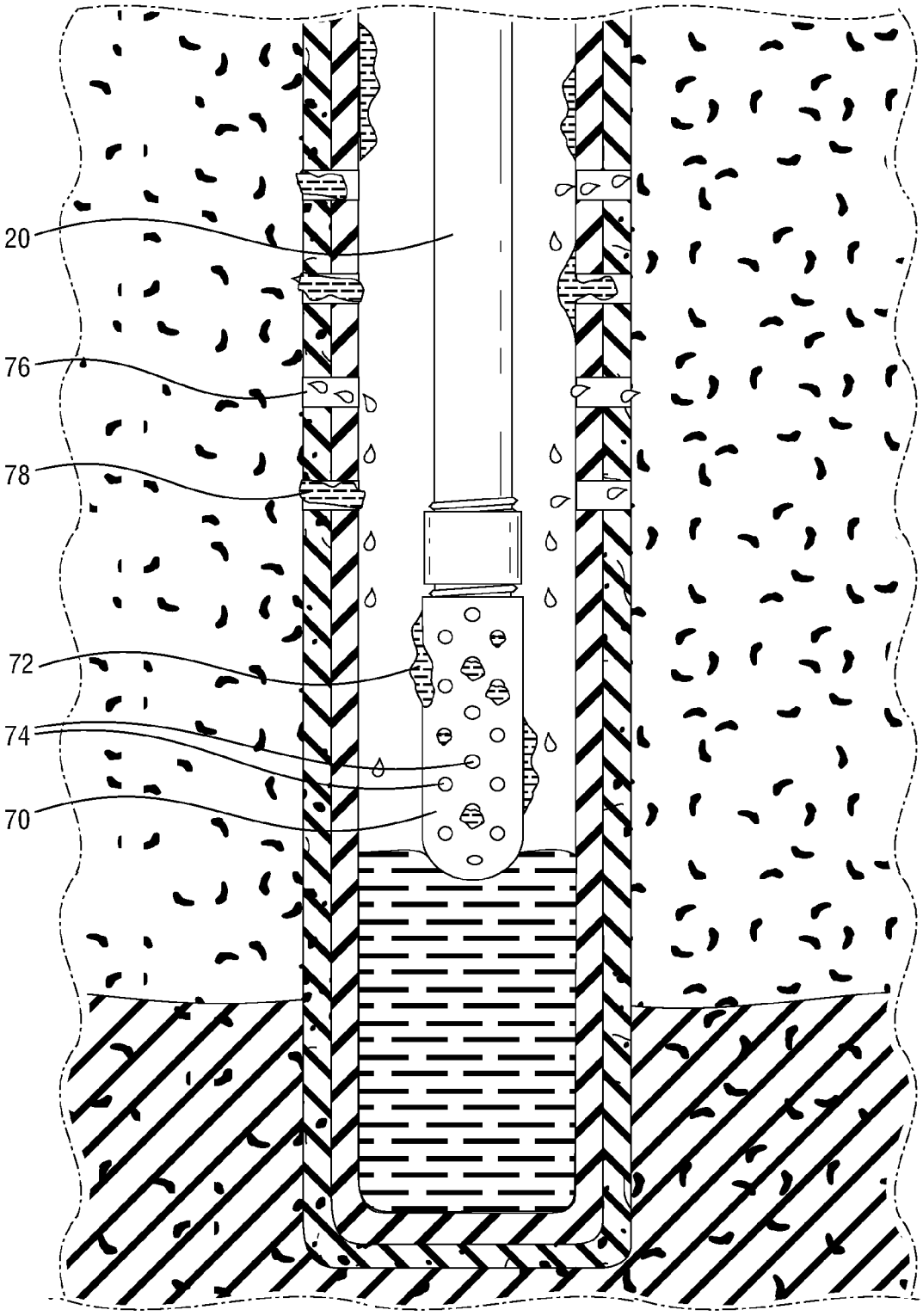
PRIOR ART FIG. 7
FIG. 7 is a fragmentary, sectional, view of the lowermost portions of a well wherein high viscous tar sands appear, which should be compared to FIG. 8 for an appreciation of the invention, and, FIG. 8 is an enlarged, fragmentary sectional view derived from circled region "8" in FIG. 6.
Figure 8:
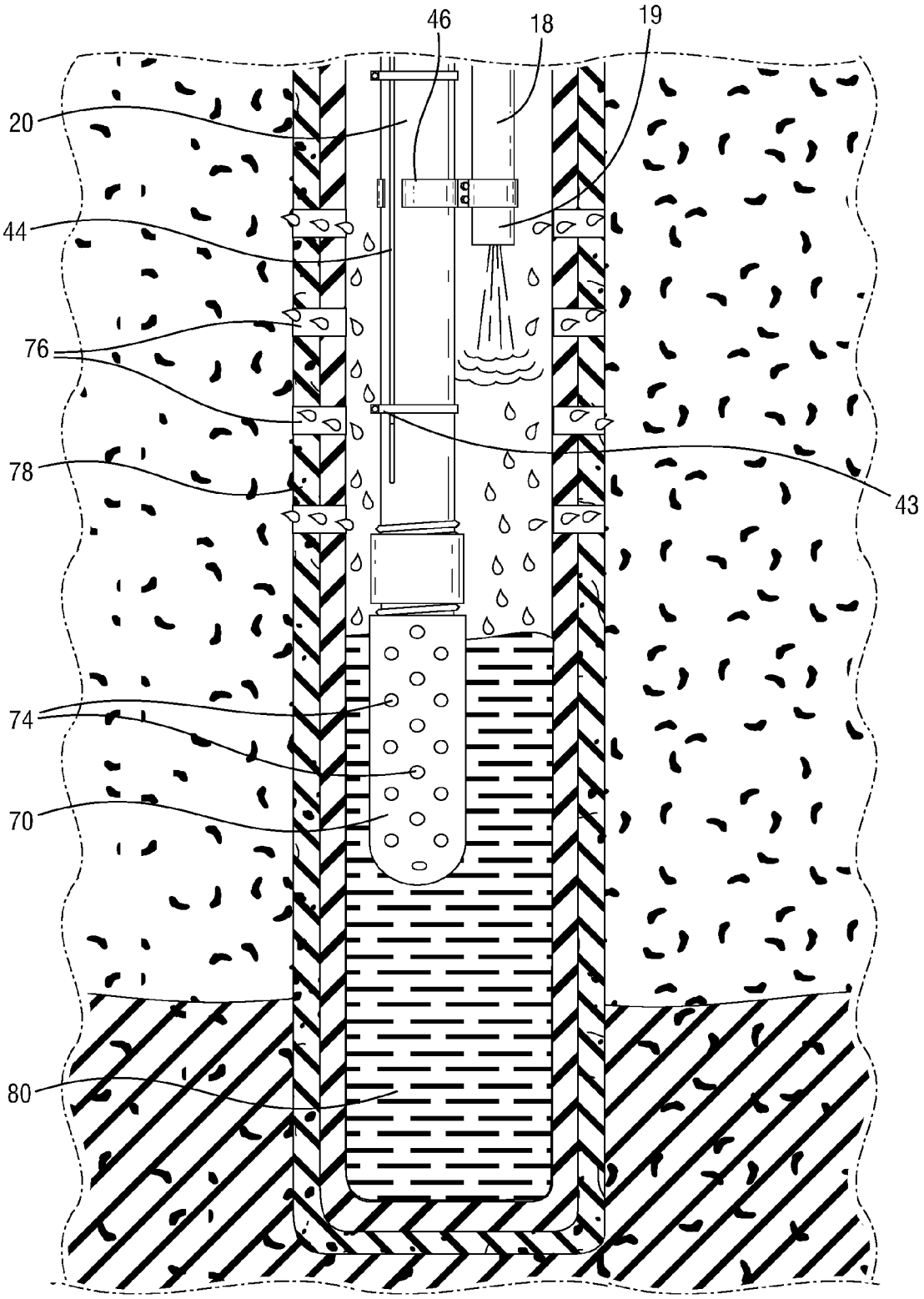

Turning to FIGS. 6-8, the production tubing 20 and steam piping 18 extend downwardly within the well casing 60 through several layers of strata 62, 63. The pay zone near the well bottom is designated generally by the reference numeral 65 (FIG. 6). The pay zone 65 is typically approximately seventy feet from the lower rat hole 67, in which there is an accumulation of liquids, comprising water, oil and possibly extraction solvents etc. The steam pipe is preferably attached to the production tubing 20.

Preferably the production tubing 20 will include a linear, generally cylindrical pump which creates lift to force crude oil to the top through the production tubing. When the original pressure that makes a gusher initially dies out, a secondary extraction process is needed. Here lift is enhanced by both the sucker rod vacuum and the production tubing lift pump. The steam piping 18 is preferably terminated generally at a midpoint in relation to the production piping, at least ten feet above the production piping lift pump.

The thermocouple monitored by line 44 is placed in a specific position in relation to the end of the steam pipe. Preferably, the thermocouple is placed approximately two feet below the end of the steam piping 18.

There is a specific method for staggering mounting the steam pipe in relation to the production tubing 20. The joints of the steam pipe should be at approximately the center of the production pipe it is being attached to provide rigidity.

FIG. 7 illustrates a prior art well that lacks steam injection. The production piping inlet head 70 has heavier, viscous extract 72 clogging its inlet orifices 74. Perforations 76 are also blocked periodically by heavy, viscous oil-bearing materials 78. It can be seen that the lack of a steam-heated local environment contributes to the buildup of viscous residues and mixtures, that limit the effectiveness and production efficiency of the well. Paraffin problems can also be remedied by steam heat that makes the paraffin more viscous.

On the other hand, the downhole temperatures at the bottom of the steam injected well (FIG. 8) are estimated at 200-400 degrees F. Steam pressure at the bottom of the well bore where the steam exits the downhole steam piping outlet 19 (FIG. 8) is preferably 40-50 PSIG in excess of the pressure sufficient to overcome the frictional pressure losses associated with the downhole piping surface roughness, the steam mass flow rate, and the downhole pipe inside geometric parameters that exist from the topside surface to the steam piping outlet 19 at the bottom of the well bore. The inlet head orifices 74 are unblocked by deposits or viscous material. The casing weep holes 76 are also unblocked. The accumulated oil extract, water and material 80 within the rat hole can be suctioned upwardly through the production tubing because of the heating effects of the steam.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations.

As many possible embodiments may be made of the invention without departing from the scope thereof, it is to be understood that all matter herein set forth or shown in the accompanying drawings is to be interpreted as illustrative and not in a limiting sense.

What is claimed is:

1. Downhole injection apparatus for injecting steam into wells equipped with at least one dual entry wellhead, production tubing extending through said wellhead into said well, and a lift pump, the production tubing comprising at least one joint, said injection apparatus comprising:

an elongated, steam output pipe that delivers steam from a steam generator for use by said apparatus;

downhole steam piping for conducting steam from said output pipe through said wellhead into said well at temperatures between 1000 and 1600 degrees F. and at a pressure between 40 to 50 PSIG over the frictional and other losses encountered from the surface to the steam piping outlet;

wherein the downhole steam piping and the production tubing are laterally stabilized by the dual entry wellhead;

downhole heat measuring means disposed within said well for sensing steam temperature; and, means for mechanically securing said downhole steam piping to said production tubing in a substantially parallel, heat exchange relationship therewith.

2. The downhole injection apparatus of claim 1 wherein steam is delivered into said well at a pressure of approximately 50 PSIG over the frictional and other losses encountered from the surface to the steam piping outlet.

3. The downhole injection apparatus of claim 2 wherein the downhole steam piping comprises heat resistant inconel stainless steel.

4. The downhole injection apparatus of claim 2 wherein said means for securing said downhole steam delivery piping to said production tubing comprises piping guides that couple said steam delivery piping and said production tubing and accommodate the differential temperatures.

5. The downhole injection apparatus of claim 4 wherein said heat measuring means is attached to the production tubing.

6. The downhole injection apparatus of claim 5 wherein said heat measuring means comprises Type K thermocouples comprising a single element, ungrounded junction.

7. The downhole injection apparatus of claim 6 wherein the thermocouple is magnesium oxide insulated.

8. The downhole injection apparatus of claim 7 wherein the thermocouple comprises type 316 stainless steel.

9. The downhole injection apparatus of claim 6 wherein the thermocouple is monitored by a digital thermometer connected through wires extending from said well.

10. The downhole injection apparatus of claim 1 wherein the downhole steam piping is terminated generally at a midpoint in relation to the production piping, above the lift pump.

11. The downhole injection apparatus of claim 6 wherein the thermocouple is placed below the end of the stream delivery pipe.

12. A method for the downhole injection of steam into wells equipped with at least one dual entry wellhead, downhole production tubing extending through said wellhead into a production zone within said well, and a lift pump, said method comprising the steps of:

providing a steam generator proximate said well for outputting a source of steam;

delivering steam from said generator to downhole steam piping that penetrates said wellhead and conducts steam into said well;

measuring steam temperature within said well beneath the steam piping;

securing said downhole steam piping to said production tubing in a substantially parallel, relationship therewith;

laterally stabilizing the downhole steam piping and the production tubing with the dual entry wellhead, and;

conducting steam through said wellhead into said well at temperatures between 1000 and 1600 degrees F. and at a pressure between 40 to 50 PSIG over the frictional and other losses encountered from the surface to the steam piping outlet.

13. The method of claim 12 wherein steam is delivered at a pressure of approximately 50 PSIG over the frictional and other losses encountered from the surface to the steam piping outlet.

14. The method as defined in of claim 12 wherein the downhole steam piping comprises heat resistant Inconel stainless steel.

15. The method as defined in claim 12 wherein said securing step comprises the step of mechanically coupling said steam piping to said production tubing with piping guides for accommodating the differential temperatures of the steam delivery pipe and said production tubing.

16. The method of claim 12 wherein said steam temperature measuring step employs Type K thermocouple probes comprising a single element, ungrounded junction.

17. The method of claims 16 including the step of insulating said thermocouple with magnesium oxide insulation.

18. The method of claim 16 wherein the thermocouple comprises type 316 stainless steel.

19. The method of claim 16 wherein the thermocouple is monitored by a digital thermometer connected through wires extending from said well.

20. The method as defined in claim 12 wherein, when wells have high paraffin, the steam delivery piping is coupled to the production tubing in heat exchange relationship.

* * * * *